United States Patent [19]

Hetke

[11] 4,034,464

[45] July 12, 1977

[54] METHOD OF ALUMINUM CYLINDER HEAD VALVE SEAT COATING TRANSPLANT

[75] Inventor: Adolf Hetke, Livonia, Mich.

[73] Assignee: Ford Motor Company, Dearborn, Mich.

[21] Appl. No.: 608,439

[22] Filed: Aug. 27, 1975

[51] Int. Cl.[2] ..... B22D 11/126

[52] U.S. Cl. ..... 29/527.6; 29/527.3; 164/80; 164/132; 164/72; 164/58; 164/59; 164/97; 428/450

[58] Field of Search ..... 29/527.6, 527.3; 164/80, 132, 72

[56] References Cited

U.S. PATENT DOCUMENTS

| | | | |
|---|---|---|---|
| 1,561,287 | 11/1925 | Stern | 164/132 |
| 3,091,549 | 5/1963 | Kanter | 117/75 |
| 3,259,948 | 7/1966 | Feagin | 164/57 X |
| 3,911,994 | 10/1975 | Truman | 164/57 |
| 3,927,450 | 12/1975 | Sommer et al. | 29/527.6 |

*Primary Examiner*—C.W. Lanham
*Assistant Examiner*—V. Rising
*Attorney, Agent, or Firm*—Joseph W. Malleck; Keith L. Zerschling

[57] ABSTRACT

A method of making aluminum castings having a self-fused high silicon content in the interior matrix near and at the surface. A sand core is coated with a tacky, low-ash, low-volatile adhesive along a predetermined zone. Silicon dust particles are deposited on said adhesive in bonded relation. Molten aluminum is cast into a mold cavity containing the coated core. After mold stripping, the silicon particles are exposed as metallurgically bonded to the aluminum but along an ultra-thin depth. At least some of the exposed silicon particles are machined to expose a planar facet and thereby increase the projected exposure of the silicon particles along the machined plane. The resulting product has a reduced shrinkage characteristic (typical of aluminum alloys having a high proportional precipitated silicon).

4 Claims, 3 Drawing Figures

METHOD OF ALUMINUM CYLINDER HEAD VALVE SEAT COATING TRANSPLANT

BACKGROUND OF THE INVENTION

Cast aluminum bodies have found particular application in engine constructions because of their light weight and thermal conductivity. In applications of this type, good wear resistance is of considerable importance; the casting industry has turned to aluminum-silicon alloys which permit refining or precipitation of silicon as a primay phase to achieve said wear resistance. The prior art has appreciated that small and well dispersed particles of primary silicon in an aluminum-silicon eutectic matrix will improve wear resistance and other physical characteristics. Commercial refiners or modifiers have been developed to effect either refinement of primary or eutectic silicon, such as phosphorous or sodium. More recently, the art has appreciated that by the introduction of aluminum oxide to the casting melt, in a finally divided and uniformly dispersed condition, both primary and eutectic silicon can be provided in a precipitated form.

As desirable as the ultimate wear characteristics of an aluminum-silicon alloy may be, there are certain cost penalties in producing such an alloy. Optimum costs can be achieved if a more simple aluminum material (less alloyed) is utilized while effecting some form of wear resistance at preferential selected surfaces of the casting where the latter is primarily required. The prior art is unable to provide and has not appreciated the benefits that can be obtained by providing a restricted zone of silicon with sufficient silicon particle surface area exposed for wear resistance and yet ultrathin to insure adequate bonding of each particle to the aluminum substrate. Attempts by the prior art to provide a composite of metal powders adhered to a differential metal substrate has been by the use of the slurry technique. A slurry mixture of extremely fine powdered metal (such as nickel) is coated upon a mold cavity or other surface defining the mold cavity. The molten casting material is poured thereinto and cast in metallurgical relationship. This technique requires removal of water constituting the slurry. The extremely fine particle size of the metal powder in the slurry prohibits satisfactory wear resistance and good metallurgical bond.

There are other problems associated with the precipitation of silicon from the aluminum matrix in an aluminum-silicon alloy. A change in density is brought about by the presence of precipitated silicon and is due primarily to two phenomenom: (a) the solid solubility of silicon and aluminum and (b) its presence in a mixture. For silicon alloys containing 1.65% silicon or less (provided such material is given a sloution heat treatment to insure that all of this silicon is in solid solution), the silicon in solution will decrease the lattice parameter of aluminum and therefore the density of the alloy will increase as a result of considerable shrinkage upon solidification. For silicon alloys containing in excess of 1.65% silicon, the latter will be out of solution and the density will be reduced by the rule of mixtures but shrinkage will still take place as a result of silicon that is in solid solution.

A typical commercial aluminum-silicon alloy for engine use is designated 390 and contains 16–18% silicon, 4–5% copper, 0.1% maximum manganese, 0.0–1.1% iron, 0.45–0.65% manganese, 0.1% maximum zinc, 0.2% maximum titanium, traces of phosphorous and the remainder aluminum. The refinement of the silicon particle size is controlled principally by the rate of cooling through the liquidus temperature range (which is approximately 1200° F). The coefficient of thermal expansion characteristic for the 390 alloy is essentially 12.0° F times $10^{-6}$ upon being heated from 68° to 572° F. This factor is in addition to the shrinkage characteristic which is the reverse of thermal expansion.

SUMMARY OF THE INVENTION

A primary object of this invention is to provide a simpler method for producing a wear-resistant aluminum casting for use particularly in automotive applications, the simpler method being characterized by greater economy, and the resulting casting being characterized by equivalent or better wear resistance than commercial aluminum-silicon alloys and by less shrinkage than aluminum-silicon alloys typically used for optimum castibility.

Still another object of this invention is to provide a method of making an aluminum engine head having valve seats, the valve seat interior surfaces containing self-fused silicon dust at predetermined locations.

Features pursuant to the above method comprise: the application of a tacky material along a surface defining the cavity for the subsequent aluminum casting, such surface being either on a core section or other mold cavity surface; a silicon dust is deposited on the tacky material, the silicon dust being characterized by a particle size of 10–40 grit; after casting aluminum in said cavity resulting in a metallurgical bond between the silicon dust and the aluminum, the zoned areas are machined to expose a substantial flat portion of each grain of the silicon dust.

DETAILED DESCRIPTION

Figure 1:
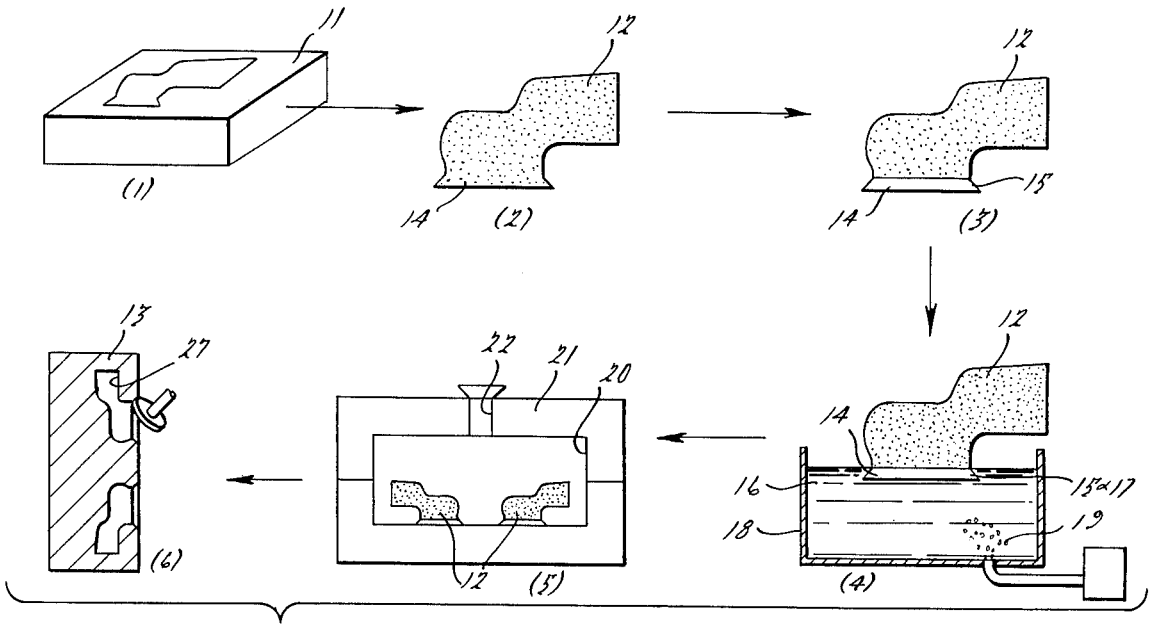
FIG. 1 is a schematic flow diagram of a preferred method of carrying out the present invention.
Figure 2:
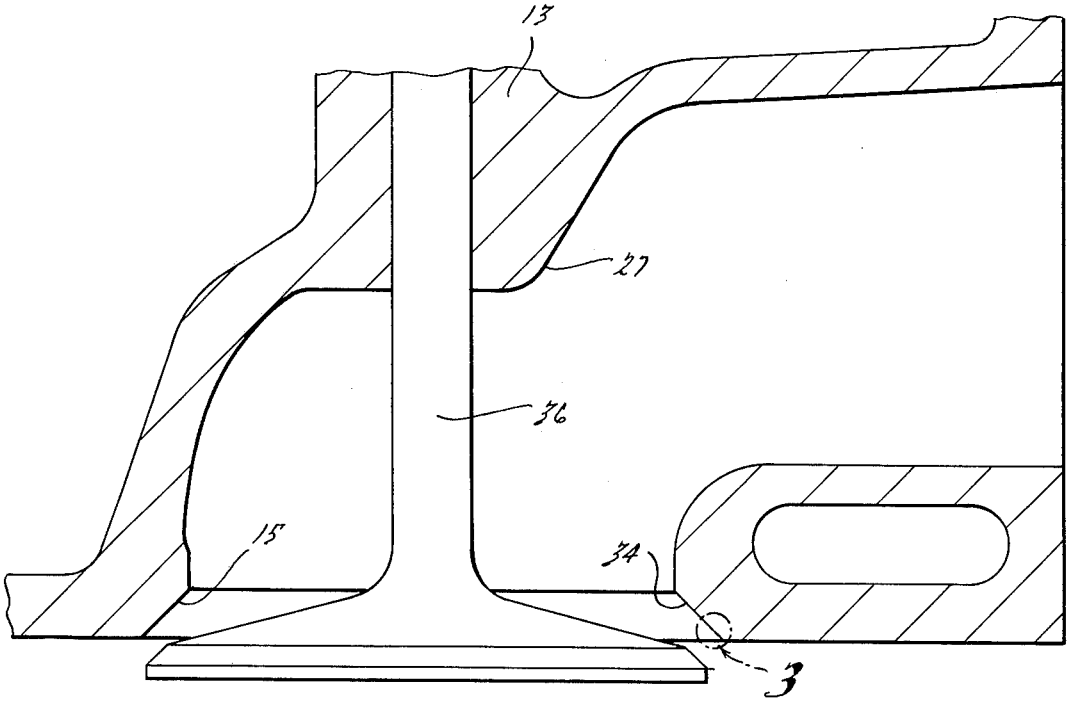
FIG. 2 is an enlarged sectional view of a portion of a casting formed by practicing the present inventive method, the casting being shown in relationship to other operative parts of an engine head construction.

A preferred method for carrying out this invention is as follows:

1. A sand core 12 is prepared by conventional techniques to define an intake port when casting the cylinder head 13 of an internal combustion engine. The core 12 is formed of collapsible material, such as resin bonded sand or unbonded compacted sand; the material must be collapsed and stripped from the completed casting. The core must be made with extremely close tolerances to accommodate the present method and therefore the core box 11, designed for making the core, must be precisely arranged so that at least the margin 14 of the core, which will define a conically shaped valve seat, is within a tolerance of ± 0.005 inches.

2. The self-sustaining core 12 is removed from the core box.

3. The conically shaped margin 14 or predetermined zone of the core 12 is coated; the coating 15 is of a low volatile, low ash tacky material which can be applied by brushing or other convenient coating technique. The tacky material should be applied in a quantity such that the thickness thereof will be no greater than 0.001 inch, but the quantity must be sufficiently continuous along the zone ultimately defining the valve seat. Tacky materials which will operate effectively to adhere subsequent metallic and or non-metallic particles thereto can be selected from the group consisting of synthemul (latex base adhesive), methylcellulose, sodium polyacrylate and other equivalent materials which will burn or vaporize upon the pressure of molten metal adjacent thereto.

4. Silicon dust 17 is deposited onto the predetermined zone 15 which has been coated with a tacky material. The silicon dust mush have a coarse grit size, particularly between 10–40 grit. Such deposition may be carried out by dipping the predetermined zone of the core into a silicon dust suspension 16 having said preferred particle size. Such suspension can be provided by having a supply of silicon dust in a container 18 and the dust fluidized by a sufficient flow of air 19 therethrough to maintain the particles in light suspension. The dust may alternatively be deposited by utilizing a pnuematic sprayer which will transport a stream of dust along with a gas, such as air, to direct the dust onto the predetermined zone. It is important that the excess dust, which has been applied to the predetermined zone, be removed by merely shaking the core or other convenient means to release the nonadhering dust therefrom. As a result, a one or two particle layer coating is achieved having some portion of each particle in contact with the tacky adhesive.

5. Here, two prepared cores 12, each with the deposit of silicon dust 15 on the tacky material, is inserted into a previously arranged mold cavity 20, such as in a sand mold 21. The core is placed in proper position, as required by the particular application and may require the use of chaplets or other means for maintaining precise positioning of the core therein. Molten aluminum, containing metallurgically preferred amounts of silicon (much lower than that required to achieve precipitated silicon), is cast into the mold cavity 20, through a conventional gating system 22. The molten aluminum vaporizes or burns off the tacky material which is positioning the silicon dust prior to casting. The aluminum is allowed to solidify forming a metallurgical bond with the silicon dust 15 on the core.

Figure 3:
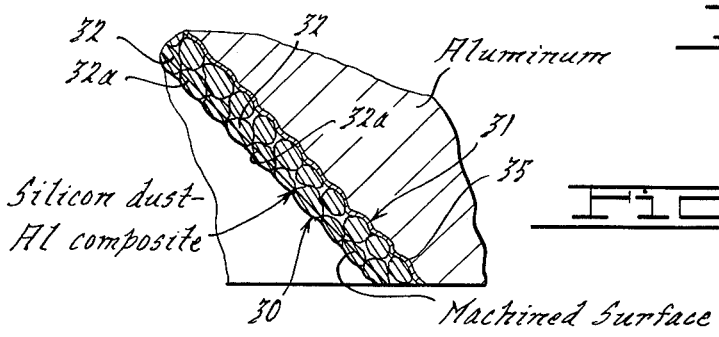
FIG. 3 is a schematic enlargement of the silicon coating construction and aluminum substrate at a selected zone thereof.

6. The solidified casting 13 is then stripped from the mold 21 and the core is collapsed and removed leaving an internal intake passage 27 or exhaust passage as the case may be. The self-fusion silicon coating 15 forming the valve seat is then machined to a depth 30, no greater than 0.03 inches of the silicon coating depth 31, whereby substantially all of the silicon particles 32 in one line are given a flat exposed surface **32*a* which constitutes at least 60% of the exposed valve seat surface 34. The entire flat surface as machined, can best be visualized by turning to FIG. 3**.

The product resulting from such casting technique will have a wear resistance characterized by no greater than 0.0001 inches in 100,000 cycles of the valve 36. This wear resistance exceeds the wear resistance of a typical 390 aluminum-silicon alloy, which is currently used in many engine applications. The self-fused silicon particle interior surface (the valve seat) will have a volume of silicon which is at least 40% by weight of the valve seat margin taken to a depth of approximately 0.060 inches. Each of the silicon particles will have an ultra-thin transition alloy zone 35 surrounding its surface (shown schematically in FIG. 3 about some of the particles) and providing a metallurgical bond with the aluminum matrix. Such transition alloy will consist of aluminum-silicon in an alloyed condition.

The aluminum will migrate to the surface about the silicon particles, but will occupy no greater than 25% of the exposed surface machining. The flat silicon particles surfaces **32*a***, exposed by machining, will provide an aluminum silicon composite surface at the desired valve seat surface location.

The shrinkage characteristic of the aluminum casting will be typical of commercially available aluminum alloys utilizing a high proportion of precipitated silicon. This compares favorably with a typical aluminum casting, made from 390 aluminum silicon, wherein the shrinkage characteristic is about 6%.

I claim as my invention:

1. A method of making an aluminum casting having a self-fused silicon dust interior surface, the method comprising the steps of:

a. preparing a selectively collapsible core with a predetermined outer surface effective to define an interior surface for said casting, b. depositing a low volatile, low-ash tacky material along a predetermined zone of the core outer surface, c. depositing silicon dust having a grit size between 10–40 on said tacky material and removing any nonadhering dust, said adhered dust defining a valve seat zone, d. after inserting said dusted core in proper position in a mold cavity, casting molten aluminum substantially devoid of silicon into said cavity, e. after solidification and stripping of said casting from said mold, collapsing said core for removal of the core material, and f. removing, by machining, no greater than 0.03 inches of said silicon dust bearing surface to expose a flat facet on the majority of silicon particles.

2. The method of making an aluminum casting as in claim 1, in which the silicon dust adhered by said tacky material to said core will occupy, after having cast molten aluminum therearound, at least 40% by weight of the valve seat zone, the remainder being aluminum.

3. A method of making an aluminum casting as in claim 1, in which during step (d) each particle is provided with a transition alloy zone about each particle metallurgically bonding said silicon particles to the aluminum substrate.

4. A method of making an aluminum casting as in claim 1, in which the aluminum in step (d) is permitted to migrate about each of said silicon particles.

* * * * *